US008328007B1

(12) United States Patent
Duffy, Jr.

(10) Patent No.: US 8,328,007 B1
(45) Date of Patent: Dec. 11, 2012

(54) BUSINESS CARD PACKAGE

(75) Inventor: William N. Duffy, Jr., Westwood, MA (US)

(73) Assignee: The Regal Press Incorporated, Norwood, MA (US)

( * ) Notice: Subject to any disclaimer, the term of this patent is extended or adjusted under 35 U.S.C. 154(b) by 0 days.

(21) Appl. No.: 13/413,249

(22) Filed: Mar. 6, 2012

(51) Int. Cl.
*A45C 11/18* (2006.01)
*B65D 83/00* (2006.01)

(52) U.S. Cl. ..... 206/39; 206/449; 150/147

(58) Field of Classification Search ..... 206/449, 206/214, 215, 831, 425, 39, 39.1, 232, 38, 206/472, 460, 37; 150/147, 149
See application file for complete search history.

(56) References Cited

U.S. PATENT DOCUMENTS

| | | | | | |
|---|---|---|---|---|---|
| 756,013 | A * | 3/1904 | Franklin | ..... | 281/19.1 |
| 807,648 | A * | 12/1905 | Wiggins | ..... | 281/31 |
| 1,462,448 | A * | 7/1923 | Rittelman | ..... | 206/39.1 |
| 1,585,789 | A * | 5/1926 | Rittelman | ..... | 206/232 |
| 2,289,028 | A * | 7/1942 | Manko | ..... | 426/5 |
| 3,136,679 | A * | 6/1964 | Bender | ..... | 206/447 |
| 4,509,196 | A * | 4/1985 | Sak et al. | ..... | 383/5 |
| 4,570,797 | A * | 2/1986 | Weinman | ..... | 206/447 |
| 4,928,814 | A * | 5/1990 | Rondot et al. | ..... | 206/215 |
| 5,415,276 | A * | 5/1995 | Welton | ..... | 206/104 |
| 7,766,166 | B2 * | 8/2010 | Cognome Dotta | ..... | 206/438 |

* cited by examiner

*Primary Examiner* — Steven A. Reynolds
(74) *Attorney, Agent, or Firm* — Cesari and McKenna, LLP; John F. McKenna

(57) ABSTRACT

A package of business cards arranged in a stack. Each card has a main body bearing data and an end tab connected to one end of the main body along a tear line, and a cover. The cover includes a back panel having a segment underlying all the end tabs and a front panel hingedly connected to the back panel adjacent to the free ends of the main bodies so that the front panel may be swung between an open position wherein it exposes the main body of the uppermost card in the stack and a closed position wherein it covers that main body. Securements secure together all the end tabs of the stack and the segment of the lower panel. An end cap covers the end tabs and provides a knife edge to facilitate tearing the main bodies from their tabs along their respective tear lines.

4 Claims, 3 Drawing Sheets

BUSINESS CARD PACKAGE

BACKGROUND OF THE INVENTION

1. Field of the Invention

This invention relates to a business card package. It relates especially to a multiplicity of business or calling cards assembled into a compact package so that individual cards can be separated easily from the package by a user and exchanged with other people.

2. Background Information

Business cards, calling cards, cards of introduction and the like, hereinafter referred to as "business cards" usually contain a person's name, address, contact information and company affiliation, if any, printed on a small, paperboard or plastic substrate. A person may typically carry a plurality of such cards in a wallet or other container from which individual cards may be withdrawn and handed out to various individuals upon meeting them for the first time. However such individual cards are easily bent and they can become soiled and otherwise defaced if they remain in a wallet or other receptacle for even a relatively short time. Resultantly, when it comes time to exchange them, they do not present a good appearance to the persons receiving them. This is a definite drawback since first impressions are very important in new relationships. Also, individual business cards have other disadvantages in that they are sometimes difficult to locate and are easily misplaced. Accordingly, it would be desirable to be able to provide business cards in a form that would avoid the aforesaid problems.

SUMMARY OF THE INVENTION

The present invention aims to provide a plurality of business cards in the form of a single package that protects the cards before they are exchanged with other individuals.

Another object of the invention is to provide a business card package which facilitates the separation of individual cards from the package so that they can be handed out easily to new acquaintances.

An additional object of the invention is to provide such a package which enables the individual cards to mutually support one another so that they remain flat and protected within the package.

Other objects will, in part, be obvious and will, in part, appear hereinafter.

The invention accordingly comprises the product possessing the features, properties and the relation of components which will be exemplified in the article hereinafter described, and the scope of the invention will be indicated in the claims.

Briefly, my business card package comprises a stack of business cards, each card consisting of a main body bearing printed information and an end tab connected to the main body along a tear line. The end tabs of all of the cards in the stack are secured together so that the cards constitute pages of a book.

The package also includes a cover having a back panel secured to the end tab of the lowest card in the stack and an upper panel hingedly connected to the lower panel so that the upper panel may be swung between an open position wherein the upper panel exposes the uppermost card in the stack and a closed position wherein the upper panel completely covers the uppermost card in the stack.

Lastly, the business card package includes an end cap dimensioned to snugly receive the end tabs of all of the cards in the stack thereby concealing the tabs. The end cap is dimensioned so that its rim or lip is located just short of the tear lines separating the main body of the cards from their end tabs. The end cap may be secured to the tabs by an adhesive or other suitable means. If desired, the front wall of the end cap may be kept separate from the uppermost end tab in the stack so that the free end margin of the cover front panel may be slid under the front wall of the end cap to retain the front panel in its closed position, much like the cover panel of a book of matches. In this case however, the end cap extends all around the end tabs so that the front wall thereof forms a stiff knife edge to facilitate tearing the main bodies of the cards along their tear lines to separate them from their respective end tabs.

When arranged in a package thusly, the business cards provide mutual support so that they are not bent or otherwise deformed when they repose for long periods in a user's pocket. Also, the package cover assures that all of the cards in the stack, at any given time, are protected from dirt and abrasion so that when it becomes time to use them, they are in a very presentable condition.

BRIEF DESCRIPTION OF THE DRAWINGS

For a fuller understanding of the nature and objects of the invention, reference should be made to the following detailed description taken in connection with the accompanying drawings, in which.

DESCRIPTION OF A PREFERRED EMBODIMENT

Figure 1:
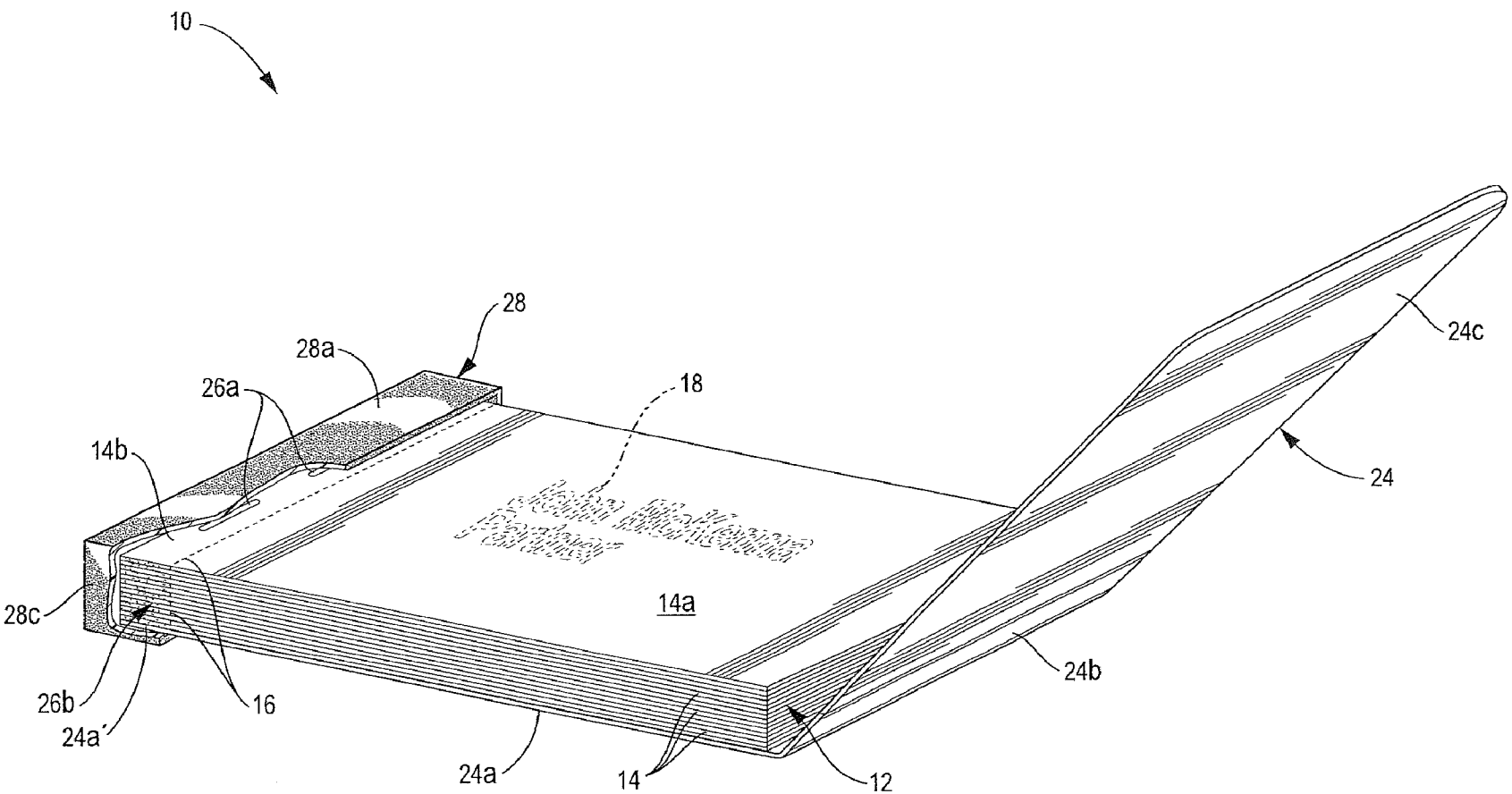
FIG. 1 is a perspective view from above of a business card package incorporating the invention, with the package cover being shown in its open position.
Figure 2:
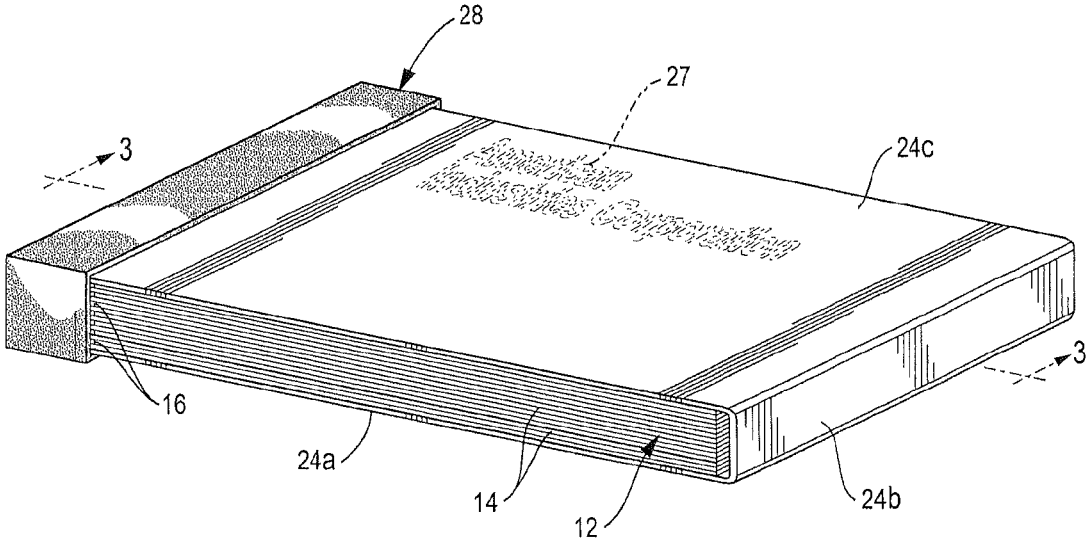
FIG. 2 is a similar view of the FIG. 1 package showing the package cover in its closed position.
Figure 3:
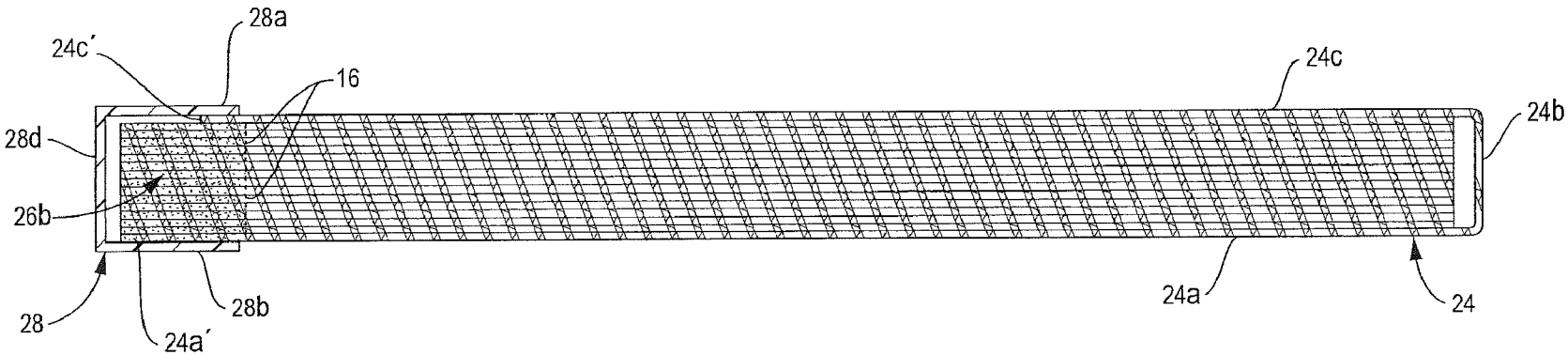
FIG. 3 is a sectional view taken along line 3-3 of FIG. 2.

Referring to FIGS. 1 to 3 of the drawings, my business card package, shown generally at 10, comprises a stack 12 of substantially identical business cards 14. Each card 14 includes a main body 14*a* and an end tab 14*b* joined to body 14*a* along a tear line 16 which may be a score line or a line of perforations. The cards 14 are preferably made of a relatively stiff sheet material such as paperboard or plastic. As best seen in FIG. 1, the card main body 14*a* carriers printed information or data shown generally at 18 which may consist of the user's name, address, business affiliation, contact information and the like.

Package 10 also includes a cover 24 of a relatively stiff paper or plastic sheet material. Cover 24 includes a back panel 24*a* having substantially the same dimensions as cards 14 so that an end segment 24*a*' of that panel underlies the card end tabs 14*b*. Cover 24 also includes an end panel 24*b* having substantially the same dimensions as the end of the card stack 12. Finally, cover 12 has a front panel 24*c* hinged to the end panel 24*b* so that the front panel 24*c* can be swung between an open position shown in FIG. 1 wherein that panel exposes the main body 14*a* of the uppermost card in stack 12 and a closed position shown in FIG. 2 wherein the upper panel 24*a* covers the main body 14*a* of the uppermost card. As shown in FIG. 2, the outer surface of panel 24*c* may bear printed characters indicated at 27 such as advertising, a design, etc.

In accordance with the invention, the end tabs 14*b* of all of the cards 14 in the stack, as well as the end segment 24*a*' of the bottom cover panel 24*a*, are secured together by suitable means such as the staples 26*a* shown in FIG. 1 or the adhesive coatings 26*b* indicated in FIG. 3.

The final component of package 10 is an end cap 28 which snugly receives, and extends all around, the end tabs 14*b* of the card stack 12. In other words, as best seen in FIGS. 1 and 3, end cap 28 is essentially a receptacle having a front wall 28*a*, a rear wall 28*b*, opposite side walls 28*c*, 28*c* and an end wall 28*d*. Preferably, end cap 28 is molded of a suitable plastic material such as polyethylene and its box-like shape makes the end cap as a whole quite rigid. End cap 28 is dimensioned so that when engaged on the end of the card stack 12, the free edge of at least its upper wall 28*a* lies just short of the tear lines 16 so that said free edge constitutes a knife edge to facilitate tearing the card main bodies 14*a* from their respective tabs 14*b* along the tear lines 16.

Desirably, end cap 28 is permanently secured to the card stack 12 by a suitable fastener in the form of an adhesive (not shown) applied between an end cap wall or walls, except top wall 28*a*, and the opposing surfaces of end tabs 24*b*. The end cap top wall 28*a* may be kept separate from the underlying end tab so that when cover 24 is in its closed position shown in FIGS. 2 and 3, an end margin 24*c*' of the cover top panel 24*c* may be slid under that wall 28*a* to retain cover panel 24*c* in its closed position. In other words, the cover top panel 24*a* is made long enough to extend beyond tear lines 16 so that, when the cover is in its closed position, the panel end margin 24*c*' may be tucked under the end cap top wall 28*a*.

It will be seen from the foregoing that end cap 28 may perform several functions, to with: provide a knife edge for cleanly separating the card main bodies 14*a* from the corresponding end tabs 14*b*; retain the cover panel 24*a* in its closed position; rigidify the overall package 10, and conceal the card end tabs 14*b* so that the package has a compact, clean-looking appearance when a user removes business cards from the package and presents them to new acquaintances.

Package 10 is also relatively easy and inexpensive to make using conventional printing and binding technology. Therefore, it should find wide acceptance particularly by businessmen who customarily carry business cards and exchange them when forming new relationships.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A business card package comprising:

a stack of business cards, each card including a main body bearing data and a short end tab connected to one end of the main body along a tear line;

a cover including a back panel underlying said stack, said back panel including a segment underlying all the end tabs and a front panel hingedly connected to the back panel adjacent to the opposite ends of the main bodies so that the front panel can be swung between an open position wherein it exposes the main body of the uppermost card in the stack and a closed position wherein it covers the main body of the uppermost card in the stack;

securements securing together said end tabs of the stack and said segment of the back panel;

an end cap shaped and dimensioned to snugly receive all of said end tabs, said end cap including a back wall, opposite side walls, an end wall and a relatively stiff front wall with a free edge extending adjacent and parallel to said tear lines so that it can function as a knife edge to facilitate the clean separation of the main bodies of said cards from the corresponding end tabs thereof along the respective tear lines, said end cap walls together forming a box-like structure;

a fastening device for fastening the end cap to said end tabs, and wherein the front wall of the end cap is not fastened to the uppermost end tab, and said cover front panel is longer than the main bodies of the cards so that when the front panel is in its closed position, a free end margin of the front panel may be tucked under said front wall of the end cap to retain that panel in said closed position.

2. The package defined in claim 1 wherein said end cap is of a plastic material.

3. The package defined in claim 1 wherein the fastening device comprises an adhesive coating between the end cap and the tabs.

4. The package defined in claim 1 wherein said securements comprise adhesive coatings or staples.

* * * * *

UNITED STATES PATENT AND TRADEMARK OFFICE

CERTIFICATE OF CORRECTION

PATENT NO. : 8,328,007 B1
APPLICATION NO. : 13/413249
DATED : December 11, 2012
INVENTOR(S) : William N. Duffey, Jr.

It is certified that error appears in the above-identified patent and that said Letters Patent is hereby corrected as shown below:

In the Specifications:

In col. 3, line 26 should read:
Perform several functions, to ~~with:~~ provide a knife edge for Signed and Sealed this
Second Day of July, 2013

Teresa Stanek Rea
*Acting Director of the United States Patent and Trademark Office*